US007540653B2

(12) United States Patent
Brinkman

(10) Patent No.: US 7,540,653 B2
(45) Date of Patent: Jun. 2, 2009

(54) MIXING MACHINE AND ASSOCIATED SEALING ARRANGEMENT FOR BEARINGS

(75) Inventor: John E. Brinkman, Tipp City, OH (US)

(73) Assignee: Premark Peg L.L.C., Wilmington, DE (US)

( * ) Notice: Subject to any disclaimer, the term of this patent is extended or adjusted under 35 U.S.C. 154(b) by 0 days.

(21) Appl. No.: 11/777,477

(22) Filed: Jul. 13, 2007

(65) Prior Publication Data

US 2008/0068925 A1 Mar. 20, 2008

Related U.S. Application Data

(60) Provisional application No. 60/845,146, filed on Sep. 15, 2006.

(51) Int. Cl.
*B01F 7/30* (2006.01)

(52) U.S. Cl. ..... 366/288; 366/207; 366/331

(58) Field of Classification Search ..... 366/64–67, 366/96–100, 287–288, 197–207, 331; 277/549, 277/572, 571

See application file for complete search history.

(56) References Cited

U.S. PATENT DOCUMENTS

| | | | | |
|---|---|---|---|---|
| RE17,215 | E * | 2/1929 | Dehuff | 366/288 |
| 3,075,746 | A * | 1/1963 | Yablonski et al. | 366/288 |
| 3,135,518 | A * | 6/1964 | Carson et al. | 277/351 |
| 3,391,940 | A * | 7/1968 | Baugh | 277/565 |
| 3,515,395 | A * | 6/1970 | Weinand | 277/559 |
| 3,572,730 | A * | 3/1971 | Otto et al. | 277/400 |

(Continued)

FOREIGN PATENT DOCUMENTS

EP 1661461 A1 * 5/2006

(Continued)

OTHER PUBLICATIONS

"How to Select the Proper Lip Design": http://www.devriesintl.com/products/shaft/howselpropseal.asp, 2006.*

(Continued)

*Primary Examiner*—Charles E Cooley
(74) *Attorney, Agent, or Firm*—Thomas Hine LLP

(57) ABSTRACT

A mixing machine includes a head extending over a bowl receiving location. The head includes a shaft receiving opening extending upwardly therein and a rotatable mixing shaft having a lower portion extending below the head and an upper portion within the shaft receiving opening. An upwardly facing bearing shoulder is within the shaft receiving opening. An upper bearing member is disposed within the shaft receiving opening and about the mixing shaft. The upper bearing member is supported by the upwardly facing bearing shoulder. A gear system is in the head for effecting planetary movement of the mixing shaft. The gear system includes a gear member disposed about an upper end of the mixing shaft and linked to the upper end of the mixing shaft for effecting rotation of the mixing shaft. The gear member is supported by an upper side of the upper bearing member and the shaft is supported by the gear member. An upper seal is located at least partially in the shaft receiving opening and positioned above the upper bearing member. The upper seal includes a radially inner lip that is biased against an outer surface of the gear member.

24 Claims, 6 Drawing Sheets

U.S. PATENT DOCUMENTS

| | | | | | |
|---|---|---|---|---|---|
| 3,586,340 | A * | 6/1971 | Otto et al. | 277/400 |
| 3,586,342 | A * | 6/1971 | Staab | 277/559 |
| 3,735,990 | A * | 5/1973 | Steegmuller | 277/346 |
| 4,573,690 | A * | 3/1986 | DeHart et al. | 277/309 |
| 4,697,929 | A * | 10/1987 | Muller | 366/97 |
| 4,704,035 | A * | 11/1987 | Kowalczyk | 366/142 |
| 4,946,285 | A * | 8/1990 | Vennemeyer | 366/288 |
| 5,028,141 | A * | 7/1991 | Stiegelmann | 366/245 |
| 5,044,642 | A * | 9/1991 | Vogt et al. | 277/559 |
| 5,934,802 | A * | 8/1999 | Xie | 366/100 |
| 6,736,404 | B1 * | 5/2004 | Shuster | 277/559 |
| 6,935,771 | B2 * | 8/2005 | Engel | 366/331 |
| 2006/0100053 | A1 * | 5/2006 | Asahi et al. | 475/221 |

FOREIGN PATENT DOCUMENTS

| | | | |
|---|---|---|---|
| FR | 2805177 | A1 * | 8/2001 |
| JP | 2004041903 | A * | 2/2004 |

OTHER PUBLICATIONS

"Standard Seal Designs": http://www.devriesintl.com/products/shaft/stdsealdsgn, 2006.*

* cited by examiner

MIXING MACHINE AND ASSOCIATED SEALING ARRANGEMENT FOR BEARINGS

CROSS-REFERENCE TO RELATED APPLICATIONS

This application claims priority to U.S. Provisional Application No. 60/845,146, filed Sep. 15, 2006.

TECHNICAL FIELD

This application relates generally to mixing machines of the type commonly used to mix food products and, more specifically, to a sealing arrangement useful in connection with such mixing machines.

BACKGROUND

Mixers are used to mix and blend a variety of materials such as food products. Planetary mixers of this type are quite common and typically include a planetary gearing arrangement within the head of the mixer. In certain instances it may be desirable to utilize a food grade grease, which can provide less effective sealing against moisture entry than thicker, non-food grade grease. Regardless of the type of grease used, it is desirable to provide effective sealing within the mixer head to limit moisture reaching the bearings in the mixer head.

SUMMARY

In an aspect, a mixing machine includes a head extending over a bowl receiving location. The head includes a shaft receiving opening extending upwardly therein and a rotatable mixing shaft having a lower portion extending below the head and an upper portion within the shaft receiving opening. An upwardly facing bearing shoulder is within the shaft receiving opening. An upper bearing member is disposed within the shaft receiving opening and about the mixing shaft. The upper bearing member is supported by the upwardly facing bearing shoulder. A gear system is in the head for effecting planetary movement of the mixing shaft. The gear system includes a gear member disposed about an upper end of the mixing shaft and linked to the upper end of the mixing shaft for effecting rotation of the mixing shaft. The gear member is supported by an upper side of the upper bearing member and the shaft is supported by the gear member. An upper seal is located at least partially in the shaft receiving opening and positioned above the upper bearing member. The upper seal includes a radially inner lip that is biased against an outer surface of the gear member.

In another aspect, a mixing machine includes a head extending over a bowl receiving location. The head includes a shaft receiving portion having an upper end, a lower end and a shaft opening extending through the shaft receiving portion from the upper end to the lower end. A rotatable output shaft is located within the shaft opening of the shaft receiving portion. The output shaft extends beyond the lower end of the shaft receiving portion to receive a mixing tool. A gear system is in the head for effecting rotation of the rotatable output shaft about a rotation axis and orbiting of the rotation axis about another axis. The gear system includes a gear member that is linked to an upper end of the rotatable output shaft for effecting rotation of the rotatable output shaft. An upper bearing member is located in the shaft opening of the shaft receiving portion and about the output shaft. The upper bearing member is located below the upper end of the shaft receiving portion to define an upper seal receiving volume within the shaft opening of the shaft receiving portion. An upper seal is located in the upper seal receiving volume. The upper seal includes an inner lip that is biased against an outer surface of the gear member.

In another aspect, a method of providing a sealing arrangement for a mixing machine is provided. The method includes locating an upper bearing member about a mixing shaft that extends through a shaft receiving opening within a head. The head extends over a bowl receiving location with the shaft having a lower portion extending below the head and an upper portion within the shaft receiving opening. The bearing member rests on an upwardly facing shoulder within the shaft receiving opening. A gear system is provided in the head for effecting planetary movement of the mixing shaft. The gear system includes a gear member disposed about an upper end of the mixing shaft and linked to the upper end of the mixing shaft for effecting rotation of the mixing shaft. The gear member is supported by an upper side of the upper bearing member and the shaft is supported by the gear member. An upper seal is located at least partially in the shaft receiving opening and positioned above the upper bearing member, the upper seal including a radially inner lip. The inner lip is biased against an outer surface of the gear member.

The details of one or more embodiments are set forth in the accompanying drawings and the description below. Other features, objects, and advantages will be apparent from the description and drawings, and from the claims.

DETAILED DESCRIPTION

Figure 1:
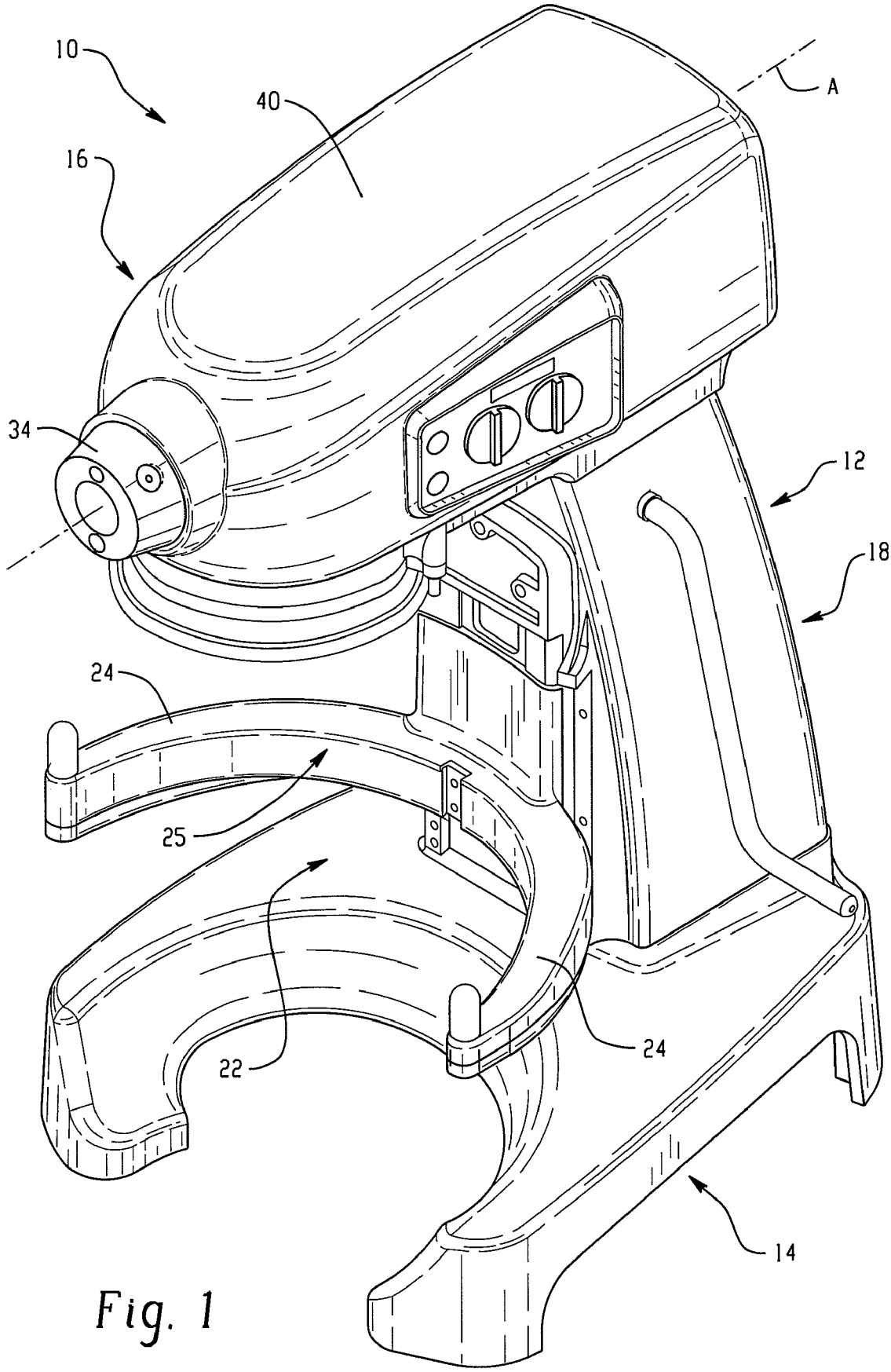
FIG. 1 is a perspective view of an exemplary mixer.
Figure 2:
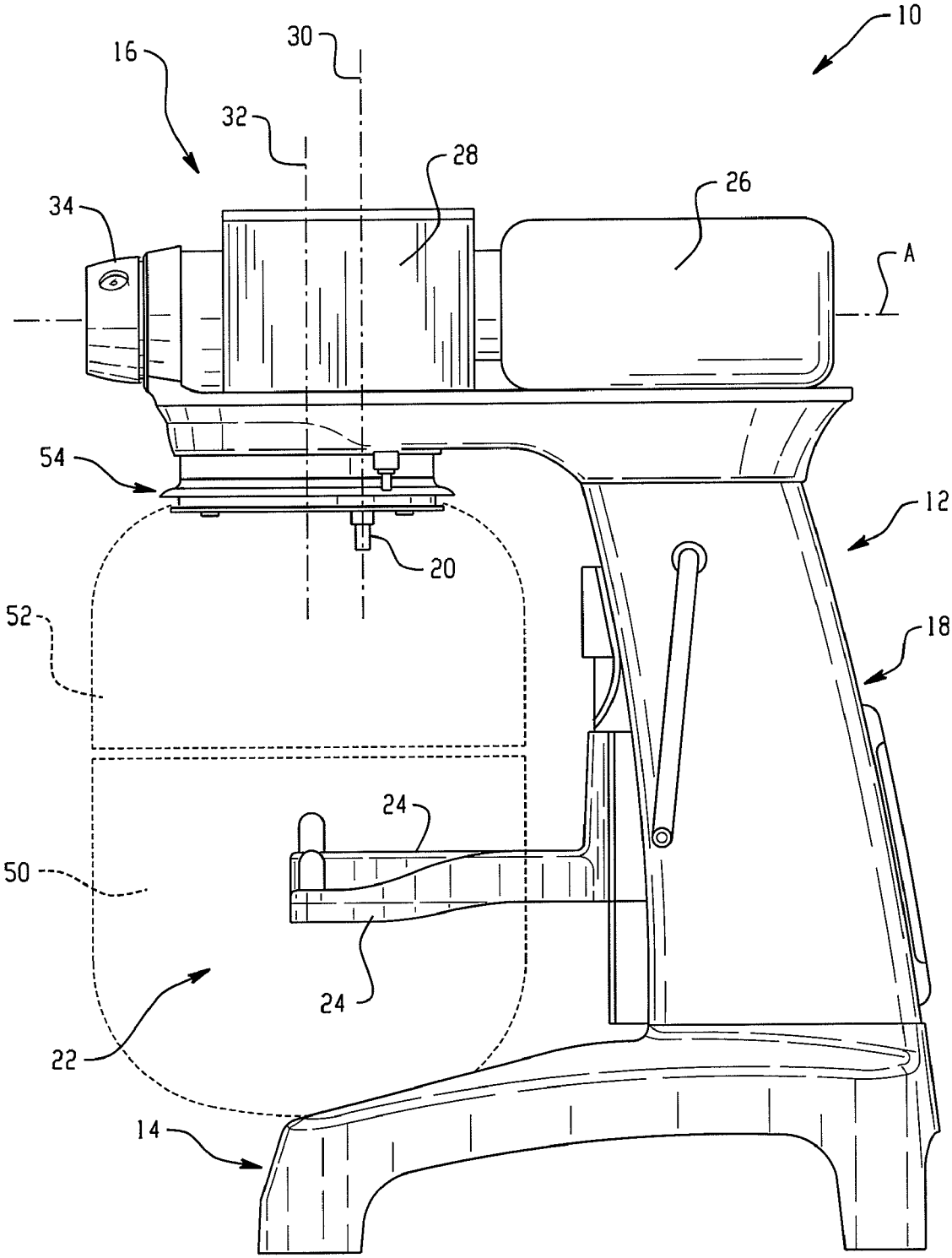
FIG. 2 is a side elevation of the mixer of FIG. 1.

Referring to FIGS. 1 and 2, a mixing machine 10 includes a mixer body 12 having a base portion 14, a head portion 16 and a support portion 18 (e.g., in the form of a column) connecting the head portion and the base portion in a vertically spaced apart relationship. A front to back head portion axis A is shown. An output member 20 (e.g., a shaft for receiving a mixer tool such as a beater or whip) extends downward from the head portion 16 in a direction toward a bowl receiving location 22 formed between the arms 24 of a bowl receiving yoke that can be moved upward and downward relative to the head portion 16 by rotation of the illustrated handle. A motor 26 may be mechanically linked to the output member 20, as by a gear system 28, for effecting rotation of the output member about a first axis 30 and orbiting movement of the output member 20 and first axis 30 about a second axis 32 (e.g., commonly referred to as a planetary movement or planetary rotation). A power take off 34 extends outwardly from a front side of the head portion 16 and may take the form of a protruding hub or boss that is adapted for connection with mixer accessories such as meat grinders, slicers etc. Internal of the power take off 34 is a drive member that is rotated by the motor 26 via the gear system 28. Head cover 40 is shown installed in FIG. 1, but is removed in FIG. 2.

An exemplary mix position of a bowl 50 is shown schematically in FIG. 2, along with an exemplary position of a bowl guard assembly 52. Bowl guard support 54 is located at the underside of the head portion 16 of the mixer and supports at least part of the bowl guard assembly 52 in a manner that enables the part to be moved between a bowl guarding position and a bowl access position.

Figure 3:
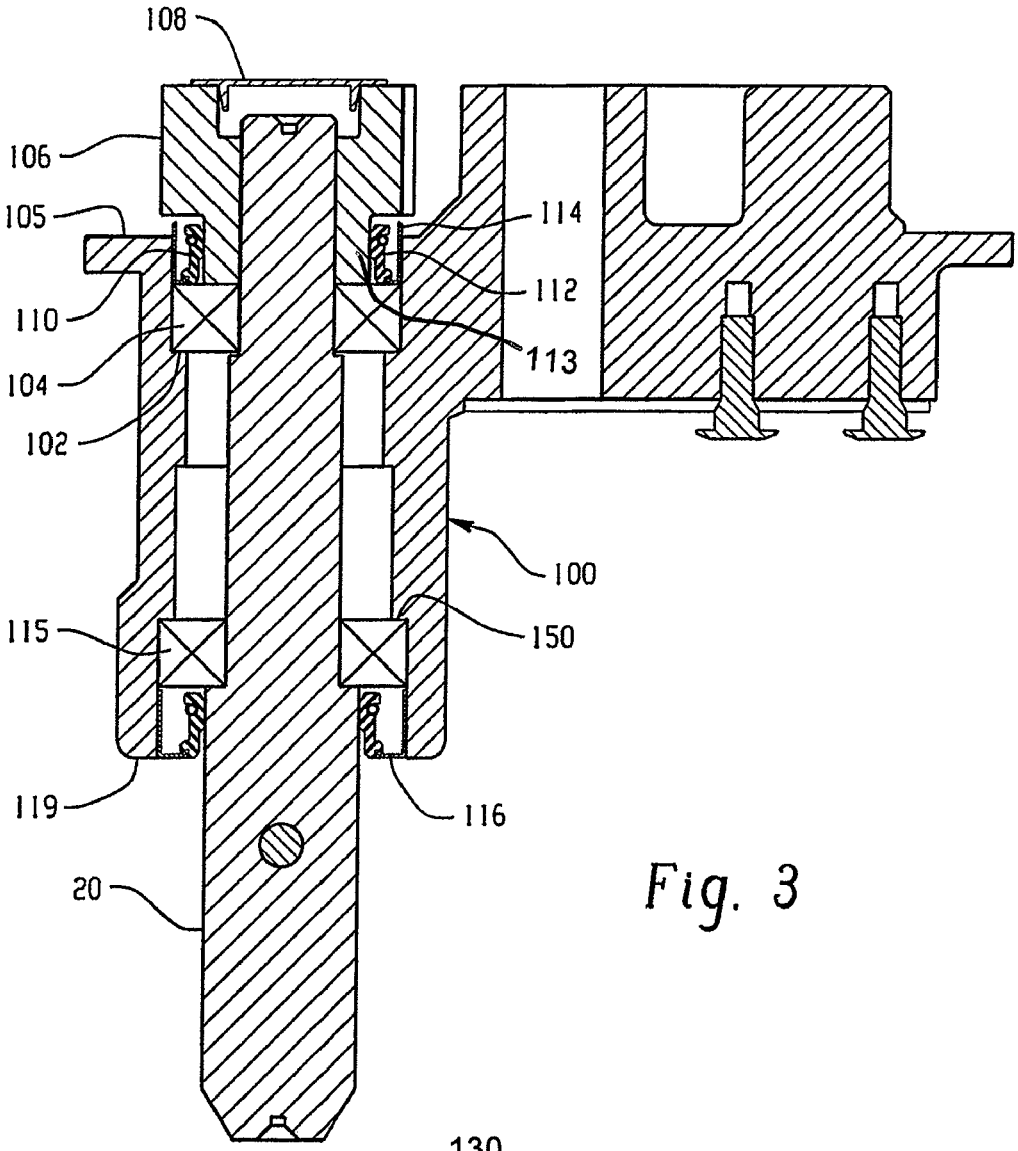
FIG. 3 is a partial cross-section of a sealing arrangement.
Figure 4:
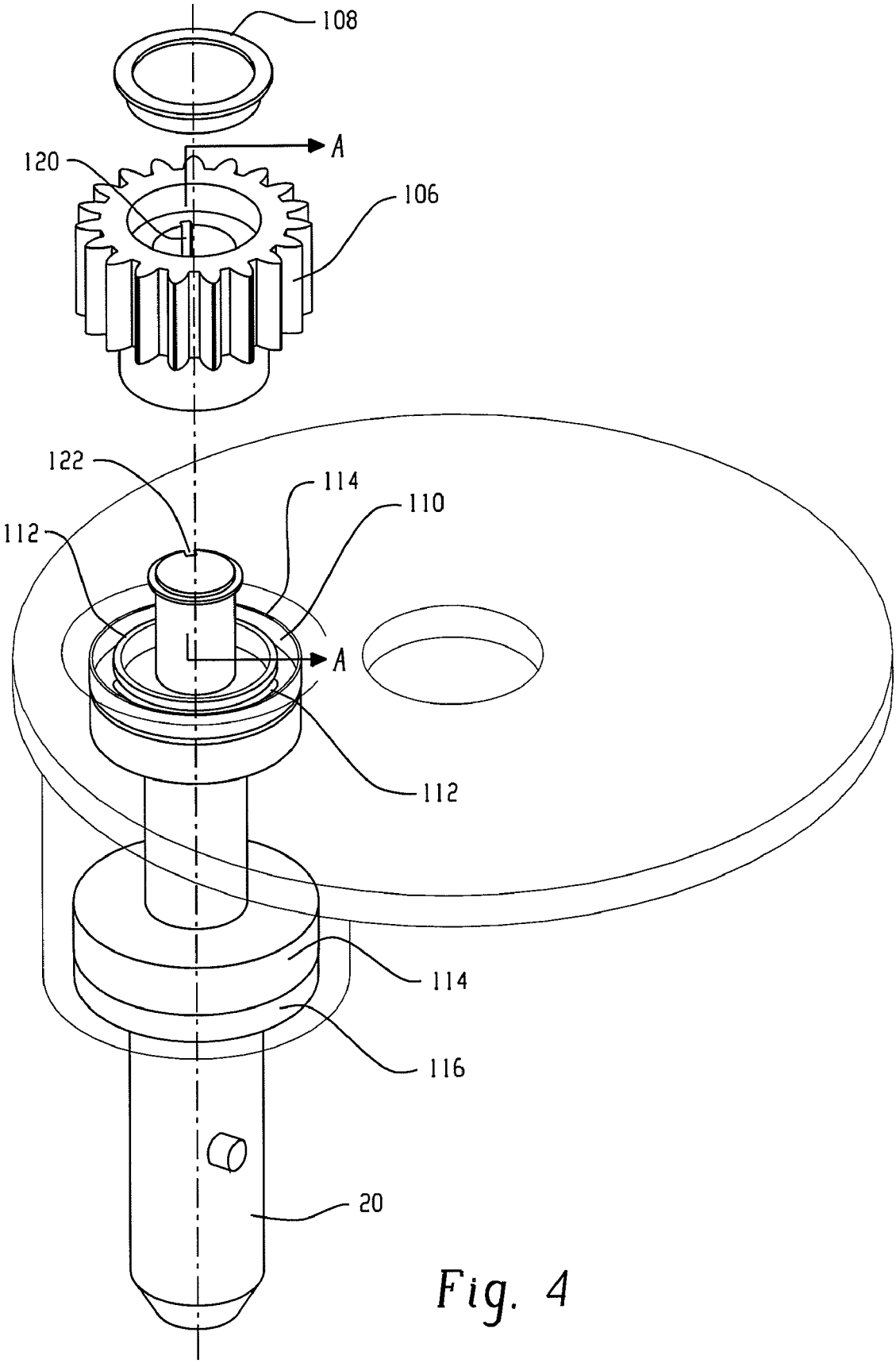
FIG. 4 is a partial perspective of the sealing arrangement.
Figure 4A:
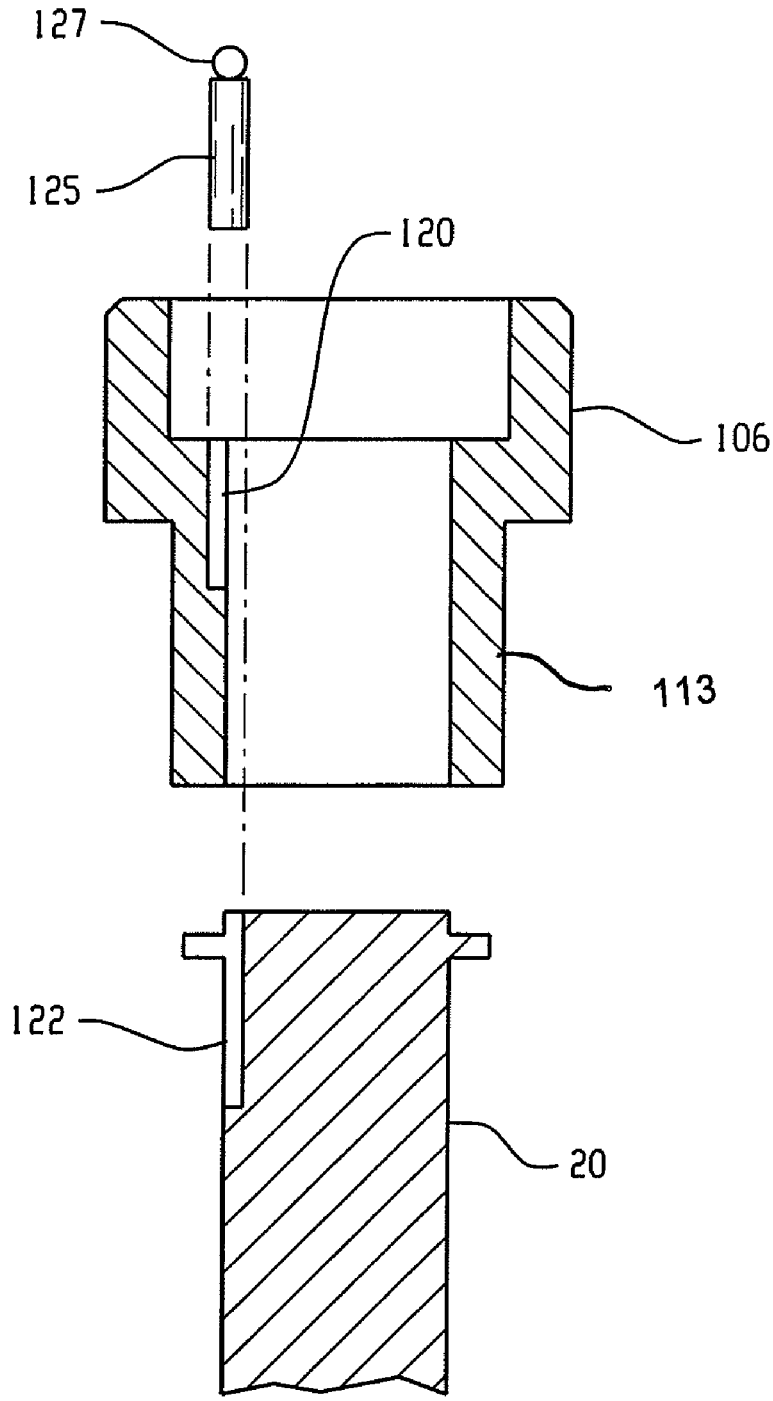
FIG. 4A is a section view along lines A-A of FIG. 4.
Figure 5:
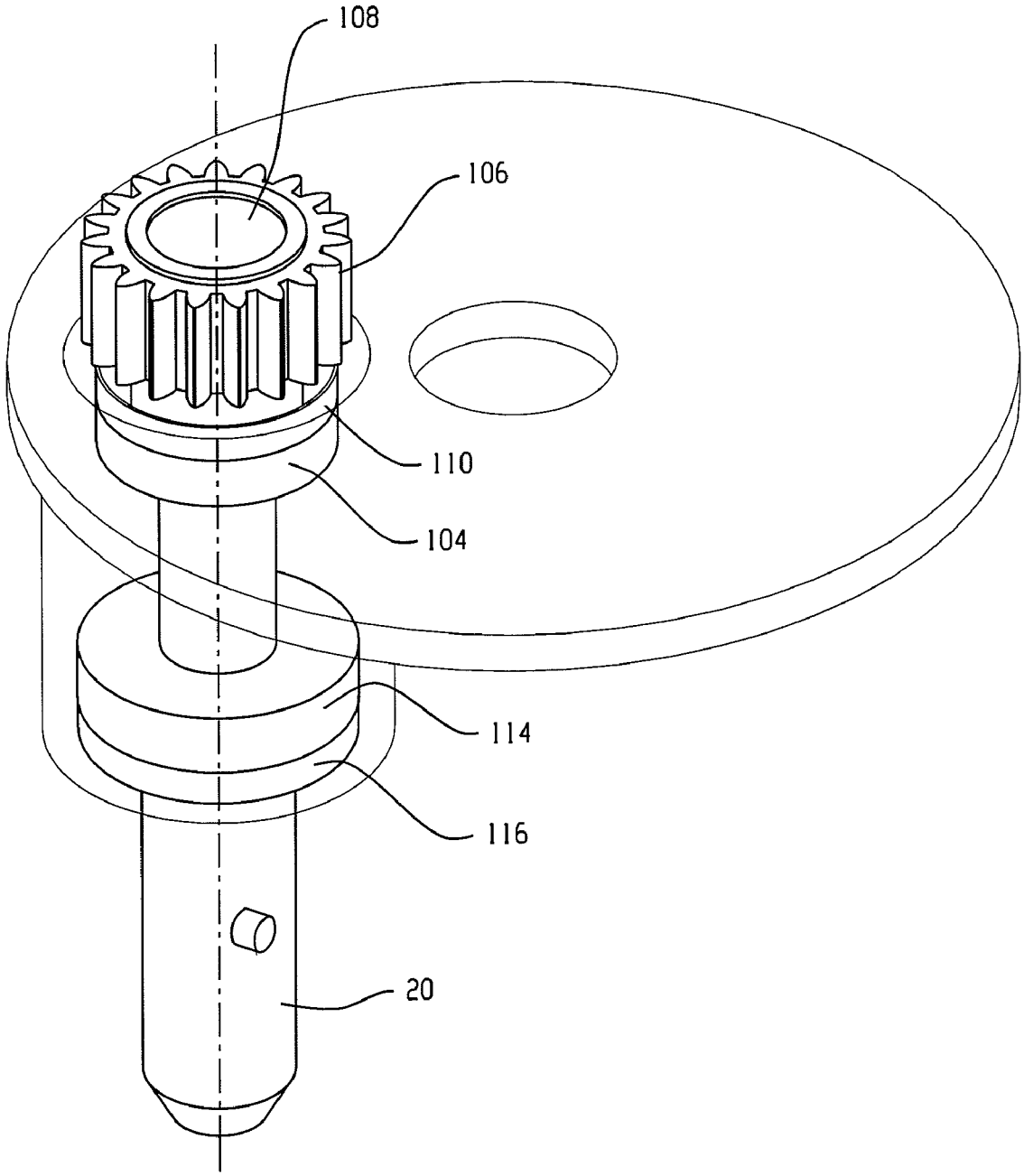
FIG. 5 is a partially exploded view of the sealing arrangement.

Referring to FIG. 3, a partial cross-section of the gearing and bearing arrangement for output shaft 20 is shown. FIG. 4 shows a partial perspective of the same arrangement and FIG. 5 shows a partially exploded view. A lower portion 100 of the mixer head is a shaft receiving portion and includes a vertically extending opening or bore with an internal bearing support shoulder 102 that is located below an upper end 105 of the shaft receiving portion. The bearing support shoulder 102 holds a bearing 104 through which the upper end of shaft 20 extends for connecting with a gear 106. The bearing 104 is located below the upper end 105 of the shaft receiving portion 100 thereby defining a shaft seal receiving volume. The gear 106 is supported on the bearing 104 and the shaft is supported by the gear 106 (e.g., via a snap ring (not shown) at the top of the shaft). In this regard, referring also to FIG. 4A, a splined or other keyed connection is provided between the outer surface of the shaft 20 and the internal surface of the gear 106 such that rotation of the gear 106 effects rotation of the shaft 20. The axial spline slot 120 may extend from an upper portion of the gear 106 only partially downward (i.e., not all the way to the bottom side of the gear) to aid in limiting or avoiding moisture travel downward along the spline path toward the bearing 104. Likewise, a corresponding spline slot 122 on the upper portion of shaft may terminate before the bottom side of the gear 106 when the gear 106 is placed on the shaft. A spline 125 can be inserted into the aligned slots 120 and 122 when they are facing each other. The spline 125 may include a removal feature 127 to aid in removing the spline from the slots. In an alternative embodiment, the gear 106 may include the spline instead of the spline slot 120.

In addition, a seal 110 is provided below the gear 106 within the shaft seal receiving volume and includes an inner seal lip 112 that is inwardly biased against the outer surface of the lower end (or gear shaft portion 113) of the gear 106 extending downwardly into the shaft seal receiving volume to further aid in limiting or preventing moisture travel downward toward the bearing 104, as well as an outer seal lip 114 pressing against the housing portion 100. The outer seal lip 114 may be fairly rigid/stiff and press fit into the housing bore to provide its sealing function. A cap seal 108 may placed in the top opening of the gear 106 to aid in limiting or preventing moisture from entering the internal space of the gear 106.

At a lower portion of the shaft an additional bearing 115 is provided to maintain the shaft in a vertical orientation and to handle upward reactionary forces of the shaft 20. The housing bore includes a downward facing bearing shoulder 150 for this purpose. The bearing 115 is located above a lower end 119 of the shaft receiving portion 100 thereby defining a shaft seal receiving volume. A seal 116 is provided below bearing 124 and within the shaft receiving volume, with seal 116 having a configuration similar to seal 110 and aiding in limiting or preventing moisture egress upward toward bearing 115.

Figure 6:
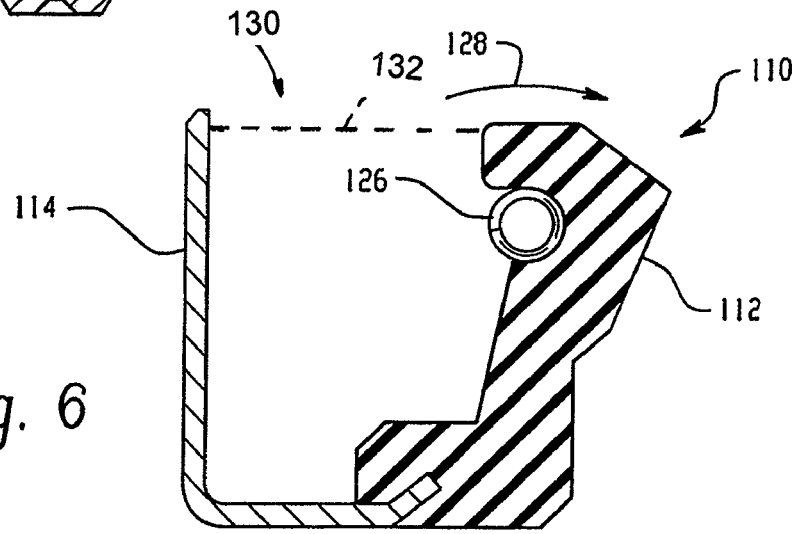
FIG. 6 is a section view of an embodiment of a seal in the sealing arrangement of FIG. 3.

Referring to FIG. 6, seal 110 is a shaft seal that includes the inner lip 112 and the outer lip 114 and a U-shaped (cross-section) channel 130 formed therebetween. A lubricant 132 may be in the channel 130. The inner lip 112 may be formed of a relatively resilient, flexible material such as an elastomer and the outer lip 114 may be formed of a relatively stiff material such as stainless steel. A biasing member 126, such as a coil spring (e.g., a garter spring) is used to provide a clamping force that biases the inner lip 112 away from the outer lip 114, in the direction of arrow 128 and toward the outer surface of the lower end of the gear 106. Seal 116 can include similar features. As one example, the seals 116 and 110 are commercially available from deVries International of Irvine, Calif.

The bearing space below seal 110 and above seal 116 may be packed with grease. Use of the sealing arrangement limits ingress of moisture into the space from either above or below, which ingress could affect bearing life.

It is to be clearly understood that the above description is intended by way of illustration and example only and is not intended to be taken by way of limitation, and that changes and modifications are possible. Accordingly, other embodiments are within the scope of the following claims.

What is claimed is:

1. A mixing machine, comprising:

a head extending over a bowl receiving location, the head including a shaft receiving opening extending upwardly therein;

a rotatable mixing shaft having a lower portion extending below the head and an upper portion within the shaft receiving opening;

an upwardly facing bearing shoulder within the shaft receiving opening;

an upper bearing member disposed within the shaft receiving opening and about the mixing shaft, the upper bearing member supported by the upwardly facing bearing shoulder;

a gear system in the head for effecting planetary movement of the mixing shaft, the gear system including a gear member disposed about an upper end of the mixing shaft and linked to the upper end of the mixing shaft for effecting rotation of the mixing shaft, the gear member including a shaft portion that extends downwardly into the shaft receiving opening and is supported by an upper side of the upper bearing member, the shaft supported by the gear member;

an upper seal located at least partially in the shaft receiving opening and positioned above the upper bearing member, the upper seal including a radially inner lip that is biased against an outer surface of the shaft portion of the gear member.

2. The mixing machine of claim 1, wherein the upper seal includes an outer lip that is press fit against a wall of the shaft receiving opening.

3. The mixing machine of claim 2 wherein the outer lip is rigid and the inner lip is flexible, the inner lip has a spring that provides a clamping force that biases the inner lip against the outer surface of the shaft portion of the gear member.

4. The mixing machine of claim 1 further comprising:

a lower bearing member disposed below the upper bearing member and within the shaft receiving opening adjacent a downwardly facing bearing shoulder of the shaft receiving opening, the lower bearing member disposed about the mixing shaft, and a lower seal located at least partially within the shaft receiving opening and below the lower bearing member, the lower shaft seal including an inner lip that is biased against an outer surface of the mixing shaft, wherein a sealed volume is defined within the shaft receiving opening between the upper seal and the lower seal, the sealed volume packed with grease.

5. The mixing machine of claim 4, wherein the upper seal includes an outer lip that is press fit against a wall of the shaft receiving opening and the lower seal includes an outer lip that is press fit against a wall of the shaft receiving opening.

6. The mixing machine of claim 5 wherein:

for the upper seal, the outer lip is rigid and the inner lip is flexible, the inner lip has a spring that provides a clamping force that biases the inner lip against the outer surface of the shaft portion of the gear member;

for the lower seal, the outer lip is rigid and the inner lip is flexible, the inner lip has a spring that provides a clamping force that biases the inner lip against the outer surface of the mixing shaft.

7. The mixing machine of claim 1, wherein the gear member includes a toothed portion and a shaft portion extending downwardly therefrom, the shaft portion defining the outer surface that the inner lip of the upper seal is biased against.

8. The mixing machine of claim 1, wherein the gear member is linked to the upper end of the mixing shaft by a spline connection, a spline groove in the gear member extends downward from an upper end of the gear member, a lower end of the spline groove located above a lower end of the gear member.

9. The mixing machine of claim 8, further comprising a cap seal connected to the gear member, the cap seal spanning a mixing shaft receiving opening of the gear member to inhibit passage of contaminants into the mixing shaft receiving opening in the gear member.

10. The mixing machine of claim 8, wherein the mixing shaft includes a spline groove that extends downward from an upper end of the mixing shaft, a lower end of the mixing shaft spline groove located above the lower end of the gear member.

11. A mixing machine, comprising:

a head extending over a bowl receiving location, the head including a shaft receiving portion having an upper end, a lower end and a shaft opening extending through the shaft receiving portion from the upper end to the lower end;

a rotatable output shaft located within the shaft opening of the shaft receiving portion, the output shaft extending beyond the lower end of the shaft receiving portion to receive a mixing tool;

a gear system in the head for effecting rotation of the rotatable output shaft about a rotation axis and orbiting of the rotation axis about another axis, the gear system including a gear member including a downwardly extending shaft portion that is linked to an upper end of the rotatable output shaft for effecting rotation of the rotatable output shaft;

an upper bearing member located in the shaft opening of the shaft receiving portion and about the output shaft, the upper bearing member located below the upper end of the shaft receiving portion to define an upper seal receiving volume within the shaft opening of the shaft receiving portion; and an upper seal located in the upper seal receiving volume, the upper seal including an inner lip that is biased against an outer surface of the shaft portion of the gear member;

wherein the gear member includes a toothed portion and the shaft portion extending downwardly therefrom, a cap seal connected to the gear member, the cap seal spanning an opening in the gear member to inhibit passage of contaminants into the opening in the gear member;

wherein the gear member includes the opening extending therethrough that receives the upper end of the output shaft.

12. The mixing machine of claim 11 further comprising a lower bearing member located in the opening of the shaft receiving portion and about the output shaft, the lower bearing member located above the lower end of the shaft receiving portion.

13. The mixing machine of claim 12 further comprising a lower seal located in a lower seal receiving volume that is defined between the lower end of the shaft receiving portion and the lower bearing member, the lower seal including an inner lip that is biased against an outer surface of the output shaft.

14. The mixing machine of claim 13, wherein the lower seal includes a spring that provides a clamping force that biases the inner lip of the lower seal against the outer surface of the output shaft.

15. The mixing machine of claim 11, wherein the upper seal includes a spring that provides a clamping force that biases the inner lip of the upper seal against the outer surface of the gear member.

16. The mixing machine of claim 11, wherein the upper seal includes an outer lip formed of a material that is harder than material forming the inner lip, the inner lip and outer lip forming a U-shaped channel therebetween.

17. The mixing machine of claim 16 further comprising a lubricant in the U-shaped channel.

18. The mixing machine of claim 11, wherein the gear member includes a spline slot extending inwardly from an inner surface of the gear member, the spline slot terminating above a bottom end of the gear member.

19. A method of providing a sealing arrangement for a mixing machine, the method comprising:

locating an upper bearing member about a mixing shaft that extends through a shaft receiving opening within a head, the head extending over a bowl receiving location with the shaft having a lower portion extending below the head and an upper portion within the shaft receiving opening, the bearing member resting on an upwardly facing shoulder within the shaft receiving opening;

providing a gear system in the head for effecting planetary movement of the mixing shaft, the gear system including a gear member disposed about an upper end of the mixing shaft and linked to the upper end of the mixing shaft for effecting rotation of the mixing shaft, the gear member supported by an upper side of the upper bearing member, the shaft supported by the gear member;

locating an upper seal at least partially in the shaft receiving opening and positioned above the upper bearing member, the upper seal including a radially inner lip; and biasing the inner lip against an outer surface of the shaft portion of the gear member.

20. The method of claim 19, wherein the step of locating the upper seal in the shaft receiving opening includes press fitting an outer lip against a wall of the shaft receiving opening.

21. The method of claim 19, wherein the inner lip is biased against the outer surface of the gear member using a spring.

22. A mixing machine, comprising:

a head extending over a bowl receiving location, the head including a shaft receiving opening extending upwardly therein;

a rotatable mixing shaft having a lower portion extending below the head and an upper portion within the shaft receiving opening;

an upwardly facing bearing shoulder within the shaft receiving opening;

an upper bearing member disposed within the shaft receiving opening and about the mixing shaft, the upper bearing member supported by the upwardly facing bearing shoulder;

a gear system in the head for effecting planetary movement of the mixing shaft, the gear system including a gear member disposed about an upper end of the mixing shaft and linked to the upper end of the mixing shaft for effecting rotation of the mixing shaft, the gear member supported by an upper side of the upper bearing member, the shaft supported by the gear member; and an upper seal located at least partially in the shaft receiving opening and positioned above the upper bearing member, the upper seal including a radially inner lip that is biased against an outer surface of the gear member;

wherein the gear member is linked to the upper end of the mixing shaft by a spline connection, a spline groove in the gear member extends downward from an upper end of the gear member, a lower end of the spline groove located above a lower end of the gear member.

23. A mixing machine, comprising:

a head extending over a bowl receiving location, the head including a shaft receiving portion having an upper end, a lower end and a shaft opening extending through the shaft receiving portion from the upper end to the lower end;

a rotatable output shaft located within the shaft opening of the shaft receiving portion, the output shaft extending beyond the lower end of the shaft receiving portion to receive a mixing tool;

a gear system in the head for effecting rotation of the rotatable output shaft about a rotation axis and orbiting of the rotation axis about another axis, the gear system including a gear member that is linked to an upper end of the rotatable output shaft for effecting rotation of the rotatable output shaft;

an upper bearing member located in the shaft opening of the shaft receiving portion and about the output shaft, the upper bearing member located below the upper end of the shaft receiving portion to define an upper seal receiving volume within the shaft opening of the shaft receiving portion; and an upper seal located in the upper seal receiving volume, the upper seal including an inner lip that is biased against an outer surface of the gear member;

wherein the gear member includes a spline slot extending inwardly from an inner surface of the gear member, the spline slot terminating above a bottom end of the gear member.

24. The mixing machine of claim 23, wherein the output shaft includes a spline slot extending inwardly from an outer surface of the output shaft, the spline slot of the output shaft terminating above the bottom end of the gear member with the output shaft connected to the gear member, the spline slots of the output shaft and the gear member being sized and arranged to receive a spline when the spline slots face each other.

* * * * *

UNITED STATES PATENT AND TRADEMARK OFFICE

CERTIFICATE OF CORRECTION

PATENT NO. : 7,540,653 B2
APPLICATION NO. : 11/777477
DATED : June 2, 2009
INVENTOR(S) : John E. Brinkman It is certified that error appears in the above-identified patent and that said Letters Patent is hereby corrected as shown below:

Claim 19, Col. 6, Line 45 after "ber" insert --including a shaft portion extending downwardly into the shaft receiving opening and--

Signed and Sealed this

Third Day of November, 2009

David J. Kappos

David J. Kappos
*Director of the United States Patent and Trademark Office*